United States Patent [19]

Keller

[11] Patent Number: 4,971,004

[45] Date of Patent: Nov. 20, 1990

[54] DECELERATION ENRICHENER SYSTEM

[75] Inventor: Ronald E. Keller, Rosondale, Wis.

[73] Assignee: Brunswick Corporation, Skokie, Ill.

[21] Appl. No.: 398,177

[22] Filed: Aug. 24, 1989

[51] Int. Cl.[5] ..... F02M 7/12

[52] U.S. Cl. ..... 123/320; 123/330; 123/437; 137/907; 251/61.3; 261/121.4; 261/DIG. 19

[58] Field of Search ..... 123/320, 325, 326, 327, 123/328, 437; 261/DIG. 19, 121.4; 137/907; 251/61.3, 61.5

[56] References Cited

U.S. PATENT DOCUMENTS

| | | | |
|---|---|---|---|
| 3,547,089 | 12/1970 | Pierlot | 261/DIG. 19 |
| 3,554,173 | 1/1971 | Masaki et al. | 261/DIG. 19 |
| 4,040,399 | 8/1977 | Meininger | 123/65 R |
| 4,053,543 | 10/1977 | Pettitt | 123/327 X |
| 4,836,506 | 6/1989 | Hundertmark | 261/23.2 |

FOREIGN PATENT DOCUMENTS

| | | | |
|---|---|---|---|
| 963763 | 3/1975 | Canada | 251/61.3 |
| 32040 | 2/1982 | Japan | 261/DIG. 19 |

OTHER PUBLICATIONS

Mercury Marine "Outboard Service Training Notebook", Brunswick Corporation Part No. 90-90592 3-1286, pp. 17, 24 and 25, 1986 (no month).

*Primary Examiner*—Tony M. Argenbright

*Attorney, Agent, or Firm*—Andrus, Sceales, Starke & Sawall

[57] ABSTRACT

In an internal combustion engine having a fuel/air delivery system such as a carburetor (12) supplying a fuel/air mixture for combustion by the engine, a deceleration enrichener system includes a valve (10) operated by engine manifold vacuum (14) and enrichening the fuel/air ratio of the mixture upon deceleration of the engine by decreasing the amount of air in the mixture. The valve (10) closes the idle air inlet port (16) of the carburetor (12) upon deceleration.

7 Claims, 1 Drawing Sheet

DECELERATION ENRICHENER SYSTEM

BACKGROUND AND SUMMARY

The invention relates to two cycle internal combustion engines, and more particularly to a system providing smoother running during deceleration.

The invention arose during continuing development efforts directed toward improving operation of two cycle outboard marine engines. Upon deceleration, the engine may sputter or even stall. It has been found that this is due to a fuel/air mixture ratio which is too lean. The present invention recognizes, addresses and solves this problem in a particularly simple and effective manner.

DETAILED DESCRIPTION

Figure 1:
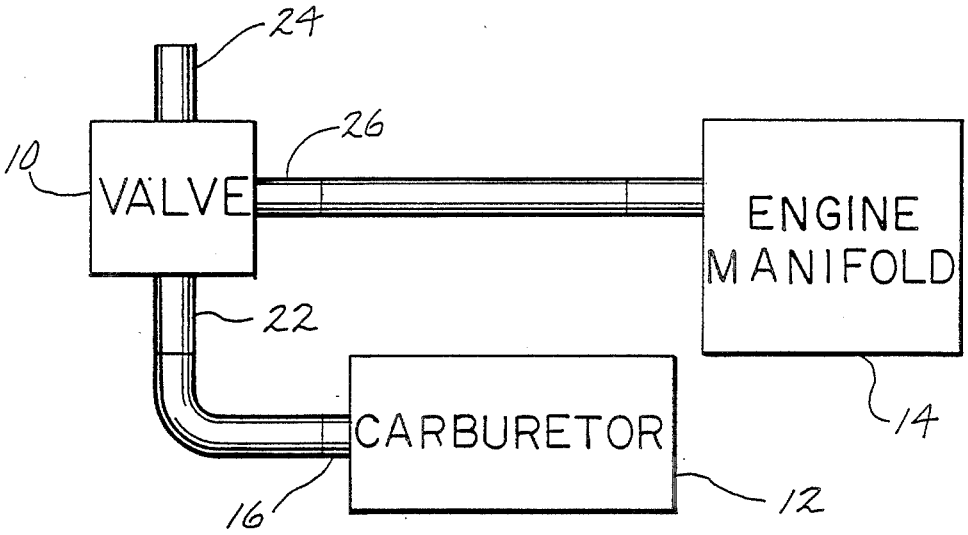
FIG. 1 is a schematic illustration of a deceleration enrichener valve and system in accordance with the invention.

FIG. 1 shows a deceleration enrichener system, including a valve 10, for a two cycle internal combustion engine having a fuel/air delivery system such as carburetor 12 supplying a fuel/air mixture for combustion by the engine. Valve 10 is operated by vacuum from the engine manifold 14 and enriches the fuel/air ratio of the mixture upon deceleration of the engine. The ratio is enriched by decreasing the amount of air in the mixture. This is done by closing the idle air inlet port 16 of the carburetor during deceleration. During normal engine operation, valve 10 is open, which allows air to enter inlet port 16, and thus maintains the normal fuel/air ratio. For further background regarding carburetor idle circuits, reference is made to Mercury Marine "Outboard Service Training Notebook", Brunswick Corporation Part No. 90-90592 3-1286, pages 17, 24 and 25, 1986.

Figure 2:
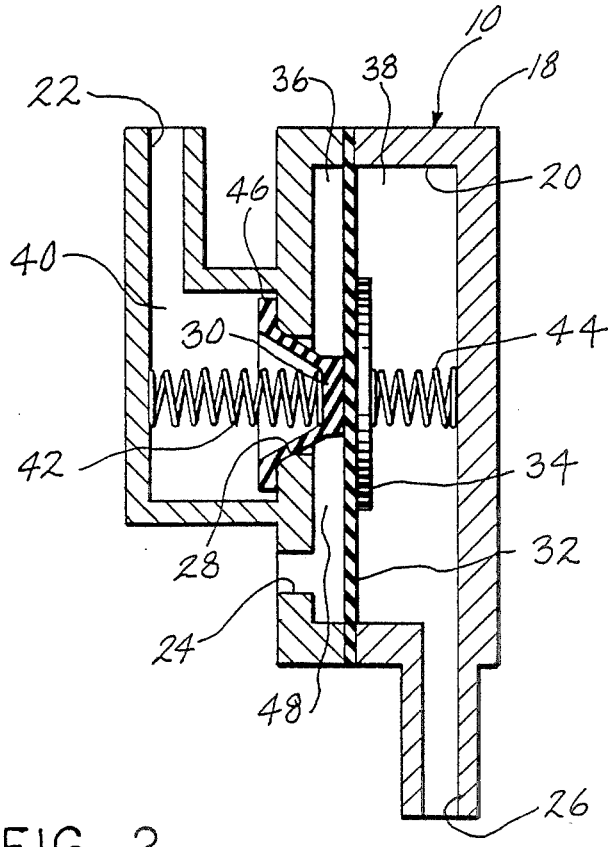
FIG. 2 is a further detailed illustration of the valve of FIG. 1.

Valve 10 is provided by a valve body 18, FIG. 2, with an internal chamber 20. A first port 22 communicates with idle air inlet port 16 of carburetor 12. A second port 24 provides an air inlet port to valve 10. A third port 26 communicates with engine manifold vacuum. A valve seat 28 is between ports 22 and 24. A movable plunger 30 responds to a first level of engine manifold vacuum under nondeceleration conditions to move leftwardly to an open position disengaging valve seat 28 and enabling communication between ports 22 and 24, and air flows from air inlet port 24 to port 22 to idle air inlet 16 of the carburetor to maintain the normal fuel/air ratio. Plunger 30 responds to a second higher level of engine manifold vacuum upon engine deceleration to move rightwardly to a closed position as shown in FIG. 2 engaging valve seat 28 and blocking communication between ports 22 and 24, such that air from port 24 is blocked from reaching port 22, and hence idle air inlet 16 of the carburetor does not receive air, which in turn enriches the fuel/air ratio.

Valve 10 includes a flexible diaphragm 32 with a plate 34 and separating chamber 20 into first and second compartments 36 and 38 on opposite sides of diaphragm 32 and isolated and sealed from each other by diaphragm 32. A subcompartment 40 communicates through valve seat 28 with compartment 36. Port 22 communicates with subcompartment 40. Port 24 communicates with compartment 36. Port 26 communicates with compartment 38.

A first spring 42 in subcompartment 40 biases plunger 30 rightwardly to the closed position engaging valve seat 28. A second spring 44 in compartment 38 biases plate 34 and diaphragm 32 leftwardly, engaging plunger 30, and moving plunger 30 leftwardly to disengage valve seat 28 and against and overcoming the bias of spring 42 when manifold vacuum is at the noted first level during nondeceleration conditions, i.e. spring 44 is stronger than spring 42. Manifold vacuum at the noted second higher level during engine deceleration in combination with the bias of spring 42 overcomes the bias of spring 44 such that plunger 30 moves rightwardly to engage and close valve seat 28 to block communication between subcompartment 40 and compartment 36, and hence block communication between ports 22 and 24.

Spring 42, plunger 30, valve seat 28 and spring 44 are all coaxially aligned. Plunger 30 extends through valve seat 28 along the axis of the noted coaxial alignment. Plunger 30 includes flanges 46 providing stop means in subcompartment 40 on the left side of valve seat 28 limiting rightward movement of plunger 30 and also providing further sealing of valve seat 28. The plunger extends rightwardly all the way through the valve seat 28 to engage diaphragm 32 in compartment 36 on the right side of valve seat 28. Port 24 is laterally spaced from valve seat 28 by a portion 48 of compartment 36 extending radially outwardly from the noted alignment axis.

It is recognized that various equivalents, alternatives and modifications are possible within the scope of the appended claims.

I claim:

1. In an internal combustion engine having a fuel/air delivery system supplying a fuel/air mixture for combustion by said engine, said delivery system having an idle air inlet port, a deceleration enrichener system including a valve operated by engine manifold vacuum and closing said idle air inlet port upon deceleration of said engine to enrich the fuel/air ratio of said mixture.

wherein said valve comprises:

a valve body with an internal chamber;

a first port communicating with said idle air inlet port;

a second port providing an air inlet port;

a third port communicating with said engine manifold vacuum;

a valve seat between said first and second ports;

a movable plunger responsive to a first level of engine manifold vacuum to move to an open position disengaging said valve seat and enabling communication between said first and second ports, and responsive to a second higher level of engine manifold vacuum upon deceleration of said engine to move to a closed position engaging said valve seat and blocking communication between said first and second ports;

a diaphragm separating said chamber into first and second compartments on opposite sides of said diaphragm and isolated and sealed from each other by said diaphragm;

a subcompartment communicating through said valve seat with said first compartment;

said first port communicating with said subcompartment;

said second port communicating with said first compartment;

said third port communicating with said second compartment.

2. The system according to claim 1 wherein said valve comprises:

a first spring in said subcompartment biasing said plunger in a first direction to said closed position engaging said valve seat;

a second spring in said second compartment biasing said diaphragm in a second direction opposite said first direction and engaging said plunger and moving said plunger in said second direction to disengage said valve seat and against and overcoming the bias of said first spring when said manifold vacuum is at said first level, and wherein said manifold vacuum at said second level in combination with the bias of said first spring overcomes the bias of said second spring such that said plunger moves in said first direction to engage and close said valve seat to block communication between said subcompartment and said first compartment, and block communication between said first and second ports.

3. The system according to claim 2 wherein said second spring is stronger than said first spring.

4. The system according to claim 3 wherein said first spring, said plunger, said valve seat and said second spring are all coaxially aligned.

5. The system according to claim 4 wherein said plunger extends through said valve seat along the axis of said coaxial alignment and has stop means thereon engaging one side of said valve seat in said subcompartment to limit movement of said plunger in said first direction, said plunger protruding beyond the other side of said valve seat in said first compartment to engage said diaphragm.

6. The system according to claim 5 wherein said stop means also seals said valve seat in said closed position of said plunger.

7. The system according to claim 5 wherein said second port is laterally spaced from said valve seat by a portion of said first compartment extending radially outwardly from said alignment axis.

* * * * *